US011708726B2

(12) United States Patent
Guerra et al.

(10) Patent No.: US 11,708,726 B2
(45) Date of Patent: Jul. 25, 2023

(54) HORIZONTAL DIRECTIONAL REAMING

(71) Applicant: QUANTA ASSOCIATES, L.P., Houston, TX (US)

(72) Inventors: Pablo Guerra, Houston, TX (US); Jason Steph, Fulshear, TX (US)

(73) Assignee: Quanta Associates, L.P., Houston, TX (US)

( * ) Notice: Subject to any disclaimer, the term of this patent is extended or adjusted under 35 U.S.C. 154(b) by 0 days.

(21) Appl. No.: 17/714,893

(22) Filed: Apr. 6, 2022

(65) Prior Publication Data

US 2022/0228441 A1 Jul. 21, 2022

Related U.S. Application Data

(63) Continuation-in-part of application No. 16/425,724, filed on May 29, 2019, now Pat. No. 11,566,473.

(60) Provisional application No. 62/677,302, filed on May 29, 2018.

(51) Int. Cl.

| | |
|---|---|
| ***E21B 7/28*** | (2006.01) |
| ***E21B 10/62*** | (2006.01) |
| ***E21B 10/26*** | (2006.01) |
| ***E21B 7/04*** | (2006.01) |

(52) U.S. Cl.

CPC ..... *E21B 7/28* (2013.01); *E21B 7/046* (2013.01); *E21B 10/265* (2020.05); *E21B 10/62* (2013.01)

(58) Field of Classification Search

CPC ..... E21B 10/12; E21B 10/20; E21B 10/22; E21B 10/26; E21B 10/28; E21B 7/28; E21B 7/046

See application file for complete search history.

(56) References Cited

U.S. PATENT DOCUMENTS

| | | | | |
|---|---|---|---|---|
| 1,847,981 A * | 3/1932 | Reed | E21B 10/22 | 175/315 |
| 2,126,034 A * | 8/1938 | Reed | E21B 10/22 | 384/92 |
| 2,704,204 A * | 3/1955 | Koontz | E21B 10/12 | 175/339 |
| 2,873,093 A * | 2/1959 | Hildebrandt | E21B 6/00 | 175/243 |

(Continued)

FOREIGN PATENT DOCUMENTS

| | | | |
|---|---|---|---|
| CN | 104126049 A * | 10/2014 | E21B 10/25 |
| CN | 108035682 A * | 5/2018 | E21B 10/28 |

(Continued)

*Primary Examiner* — Jennifer H Gay

(74) *Attorney, Agent, or Firm* — Oathout Law Firm; Mark A. Oathout; Elizabeth Gray

(57) ABSTRACT

The disclosure relates to embodiments of horizontal directional drilling equipment and methods for horizontal directional drilling techniques including a reamer head comprising a frustoconical body, wherein the frustoconical body defines a cavity configured to receive at least one bearing; and a plurality of teeth mounted to the frustoconical body. An imaginary apex of the frustoconical body is superimposed on the centerline of a reamer or reaming apparatus for reaming of an underground arcuate path. In another embodiment the reamer head is a progressive independently segmented reaming head. A plurality reaming heads are mounted to a reaming apparatus for reaming of an underground arcuate path.

7 Claims, 10 Drawing Sheets

(56) References Cited

U.S. PATENT DOCUMENTS

| | | | | | |
|---|---|---|---|---|---|
| 2,887,301 | A * | 5/1959 | Day | E21B 10/28 | 175/339 |
| 3,094,177 | A * | 6/1963 | Williams, Jr. | E21B 10/08 | 175/376 |
| 3,726,350 | A * | 4/1973 | Pessier | E21B 10/26 | 175/376 |
| 5,456,328 | A * | 10/1995 | Saxman | E21B 10/28 | 175/376 |
| 5,628,585 | A * | 5/1997 | Parish, II | E21B 7/20 | 405/184 |
| 6,386,298 | B1 * | 5/2002 | Smith | E21B 10/20 | 175/406 |
| 7,152,702 | B1 * | 12/2006 | Bhome | E21B 10/345 | 175/413 |
| 7,243,737 | B2 * | 7/2007 | Michael | E21B 10/26 | 175/385 |
| 7,320,375 | B2 * | 1/2008 | Singh | E21B 10/16 | 175/371 |
| 8,579,050 | B2 * | 11/2013 | Pessier | E21B 10/28 | 175/344 |
| 9,611,698 | B2 * | 4/2017 | Maher | E21B 10/24 | |
| 10,364,611 | B2 * | 7/2019 | Lubberger | E21B 10/28 | |
| 2006/0249311 | A1 * | 11/2006 | Thuresson | E21B 10/24 | 175/228 |
| 2007/0017709 | A1 * | 1/2007 | Singh | E21B 10/20 | 175/365 |
| 2009/0166093 | A1 * | 7/2009 | Pessier | E21B 10/28 | 175/335 |
| 2009/0218140 | A1 * | 9/2009 | Pessier | E21B 10/28 | 175/335 |
| 2010/0252326 | A1 * | 10/2010 | Bhome | E21B 10/28 | 175/57 |
| 2011/0079440 | A1 * | 4/2011 | Buske | E21B 10/28 | 175/335 |
| 2011/0315452 | A1 * | 12/2011 | Buske | E21B 10/14 | 175/336 |
| 2013/0133954 | A1 * | 5/2013 | Mohon | E21B 10/25 | 175/344 |
| 2014/0338979 | A1 * | 11/2014 | Gunsaulis | E21B 10/28 | 175/344 |
| 2014/0338984 | A1 * | 11/2014 | Maher | E21B 10/20 | 175/336 |
| 2016/0305189 | A1 * | 10/2016 | Lubberger | E21B 10/28 | |
| 2019/0360274 | A1 * | 11/2019 | Tian | E21B 10/62 | |
| 2019/0368273 | A1 * | 12/2019 | Guerra | E21B 7/28 | |
| 2022/0228441 | A1 * | 7/2022 | Guerra | E21B 10/265 | |

FOREIGN PATENT DOCUMENTS

| | | | | |
|---|---|---|---|---|
| CN | 108360979 | A * | 8/2018 | E21B 10/08 |
| DE | 1119194 | B * | 12/1961 | |
| DE | 102013111350 | A1 * | 4/2015 | E21B 10/26 |
| GB | 2435281 | A * | 8/2007 | E21B 10/25 |
| GB | 2467203 | A * | 7/2010 | E21B 10/08 |
| WO | WO-9634225 | A1 * | 10/1996 | E03F 3/06 |
| WO | WO-0192678 | A1 * | 12/2001 | E21B 10/20 |
| WO | WO-2009086287 | A2 * | 7/2009 | E21B 10/28 |
| WO | WO-2013040408 | A2 * | 3/2013 | B23P 6/00 |

* cited by examiner

HORIZONTAL DIRECTIONAL REAMING

TECHNICAL FIELD

The disclosure relates to the field of horizontal directional drilling or reaming techniques and equipment for drilling holes or boreholes for installation of pipe underground or under obstacles, such as a body of water.

BACKGROUND

Cone-shaped drill bits or cones or cutters have been used to make bore or hole enlargement tools called reamers or hole openers. A split-bit reamer is a type of reamer featuring cones or cone drill bits. The split-bit reamer is a tool often of larger diameter and is of particular use in horizontal directional drilling applications.

Some examples of prior art cone drill bits and split-bit reamers are shown in FIG. 1, FIG. 2 and FIG. 3.

FIG. 1 shows a typical drill bit third (i.e. of a tri-bit drill head) or reamer cone and arm/leg, which is cutting element with an arm and a rotating cone. The intersection of the dashed lines M & N shows the center of rotation O for the cone along the tool axis of rotation or axle. The typical drill bit third or reamer cone represented is rounded at its apex (i.e. at a distance D which does not coincide with the center of rotation of a prior art split-bit reamer).

FIG. 2 shows five cones of drill bits mounted forming a split-bit reamer. Each drill bit cone represented in FIG. 2 (five shown) is a solid body and is not segmented and it may have or not surface lines or grooves showing a step-like exterior substantially conical body all as one unitary body upon which the cutting teeth are mounted in rows. The center of rotation of one of the five cone drill bits is marked in the drawing with a plus (+) sign X (located off-center of the center of rotation Y of the reamer). The center of rotation of the reamer Y along its axis of rotation is also marked with a plus (+) Y sign (located as the center of the reamer) in the drawing. The center of rotation of the drill bit cone X (O in FIG. 1) is distant from the center of rotation Y for the reamer leading to friction of drag. The distance between the center of rotation of a cone X (or O) and the center of rotation of the reamer Y becomes more exaggerated or greater the larger the diameter of the reamer tool.

FIG. 3 shows a typical internal bearing mechanism between an arm of a split-bit reamer cutter and the typical cone. The bearing mechanism can only feature small, weaker bearings proximate the apex of the cone due to the shape of the cone (.i.e. the narrow area or volume proximate the apex of the cone due to its angularity only allows room for smaller and/or shorter cylindrical bearings).

The prior art cones and split-bit reamer create mechanical inefficiency at the cones. The drill bit cones do not and cannot match at each respective row of teeth the rotational speed of the overall reamer around their axles, and hence the tangential speed at the cone surface of the drill bit cone cannot be efficiently matched or correlated with the tangential speed due to the rotation around the longitudinal axle of the split-bit reamer as further described below.

When a cone drill bit rotates around the axle of a reamer due to the application of a force on the tool, e.g. via drilling mud/fluid, (this force is the driving factor for the reamer to drill through earth, ground or rock), every tooth on the cone will have a tangential speed, determined by the angular speed or rotational speed of the cone. Since the tangential speed depends on the angular speed and the radius, due to the triangular cross-sectional shape of the cone, the teeth that are farther away or mounted at a greater radial distance from the axle of the cone will have a higher tangential speed than the teeth close to the "tip" of the cone. The teeth located at a farther distance from the axle, i.e. the ones close to the "base" of the cone and referred to as gauge teeth, will create a higher momentum than the teeth located closer to the axle of the cones, i.e. the teeth closer to the "tip" of the cone, once a friction force is created in between each respective tooth and the earth, ground or rock that is being drilled (reamed).

Due to this momentum's difference, the gauge teeth will establish the rotational speed of the cone, trying to match their tangential speed around the cone's axle with the tangential speed according to their position on the reamer. This creates significant mechanical inefficiency. The teeth closer to the tip of the cones do not have enough tangential speed around the cone's axle to match the tangential speed established by the rotation of the reamer. As a consequence of this inefficiency, the teeth successively and relatively closer to the tip of the cones have imperfect contact with the earth, ground, or rock which causes teeth to skid or drag over the rock, inefficiently scratching or scrapping its surface and often ineffectively drilling or crushing the earth, ground, or rock. The inefficiency may be especially disruptive in situations where the geological material being reamed comprises rock or hard rock. The mechanical inefficiency giving rise to scratching or scraping action, instead of a crushing action, causes teeth successively and relatively closer to the tip of the cones to become flat (worn) sooner than the gauge teeth.

When teeth become flat, the rate-of-penetration ("ROP") of the reamer or the speed at which the reamer drills through the earth, ground or rock decreases. When the ROP reaches the minimum acceptable value, it forces the driller or operator to trip out the reamer to change it with another unit. The lifetime of the reamer and the ROP of the reamer are negatively affected by this mechanical inefficiency. Additionally, the greater the distance between the center of rotation of a cone and the center of rotation of the reamer, the greater or more pronounced is the mechanical inefficiency.

Examples of back reaming are included in US Patent Publication No. 2014/0338984 and U.S. Pat. No. 7,243,737 which are herein incorporated by reference in their entireties.

BRIEF SUMMARY

The desired concept of reaming the earth, ground, or rock with drill bits or reamer heads should be that every tooth will be pushed against the rock producing a crushing effect, and that the combination of the rotational movement plus the injection of drilling fluid at high speed will evacuate the pieces of crushed rock, called cutting, leaving the surface of the rock clean for the next tooth to repeat the process. The present disclosure relates to embodiments of horizontal directional drilling equipment and methods for horizontal directional drilling techniques which more efficiently achieve the desired crushing effect.

The present disclosure relates to embodiments of an improved reamer head or apparatus for reaming an underground arcuate path having a reaming head in one embodiment as a frustoconical or truncated cone, or conical frustum shape or substantially frustoconical, truncated cone, conical frustum shape, or frustoconical body. An imaginary apex of the frustoconical body is superimposed on the centerline of a reamer or reaming apparatus for reaming of an underground arcuate path.

Further, the present disclosure relates to embodiments of a reamer apparatus for reaming an underground arcuate path or split-bit reamer featuring in one embodiment a plurality of improved reamer heads having a frustoconical, truncated cone, or conical frustum shape or substantially frustoconical, truncated cone, or conical frustum shape.

Additionally, the present disclosure relates to embodiments of an improved bearing mechanism for a reamer arm and reamer head.

The present disclosure also relates to embodiments of an apparatus for reaming an underground arcuate path or roller cone reamer head or progressive independently segmented reaming head.

BRIEF DESCRIPTION OF DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION OF EXEMPLARY EMBODIMENTS

The description that follows includes exemplary apparatus, methods, techniques, and instruction sequences that embody techniques of the inventive subject matter. However, it is understood that the described embodiments may be practiced without these specific details.

Figure 4:
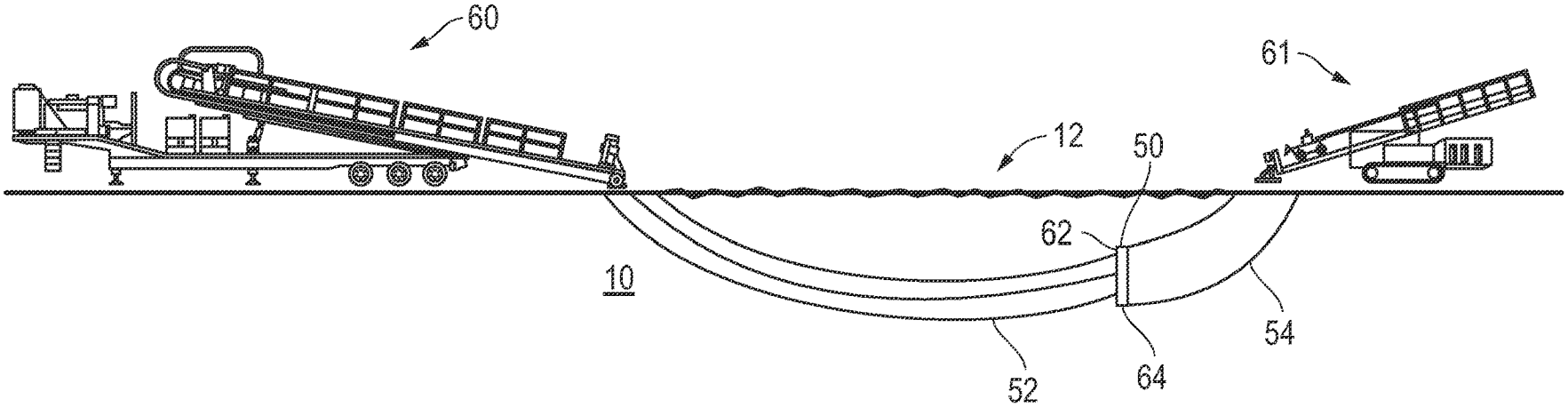
FIG. 4 depicts a schematic elevation view of an exemplary embodiment of a reamed hole crossing along an underground arcuate path after a prior drilled and/or reamed hole crossing.

Referring to FIG. 4, the hole 52 is reamed by the reamer 50 to make a larger hole 54. A pilot hole (not shown or potentially 52) is drilled to begin a crossing. The pilot hole may be reamed after drilling to make an intermediate or relatively larger hole 52. The intermediate hole 52 is reamed against walls 53 by reamer 50 to make a larger hole 54. The reamer 50 was dispatched from the rig 61 opposite drilling rig 60 and drills the arcuate path or crossing 54 through the earth 10 and may cross beneath an obstacle 12 such as, for example, a body of water, a transportation way, etc.

Figure 5:
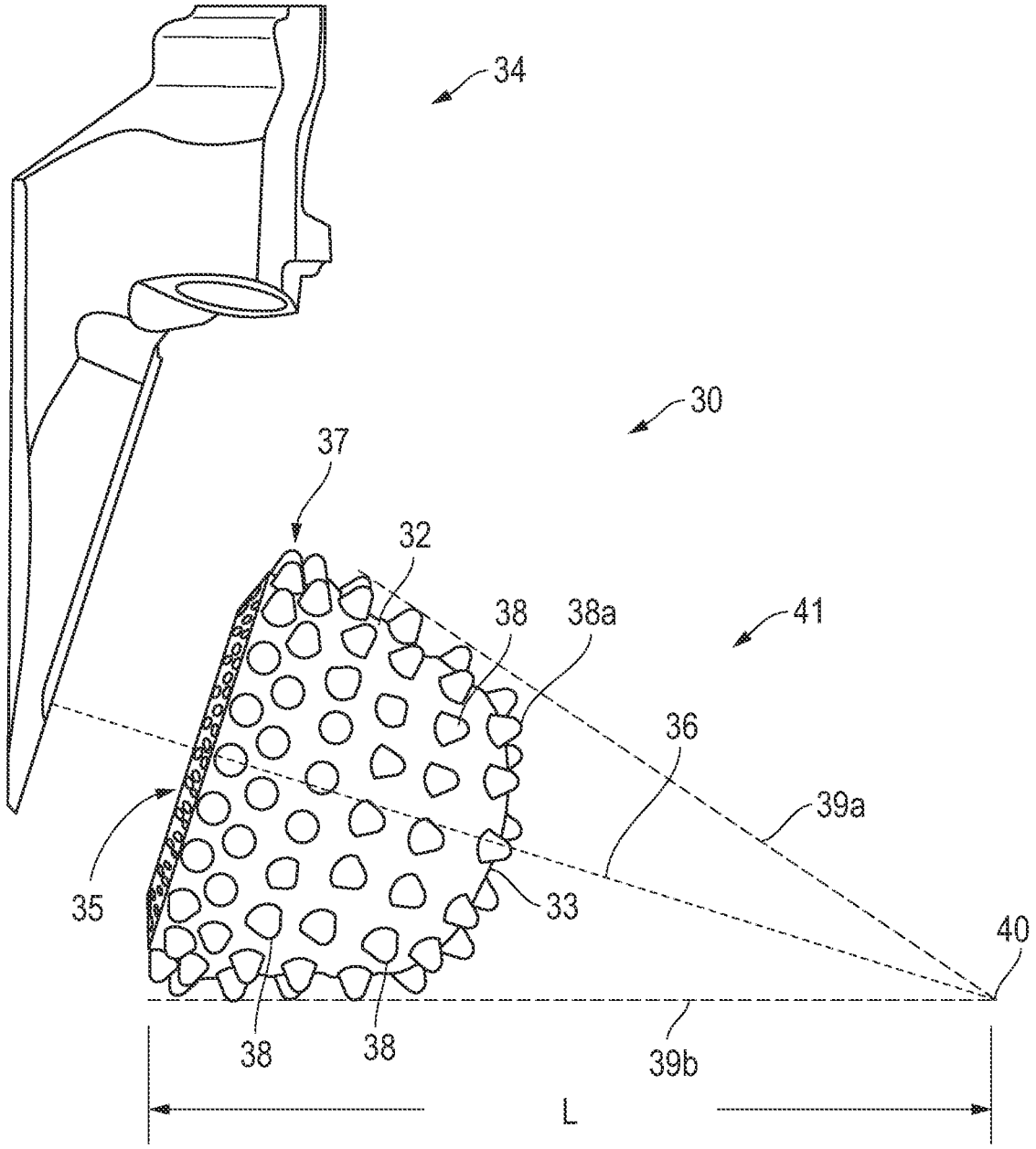
FIG. 5 shows an exploded view of an exemplary embodiment of an improved reaming head and arm.

FIG. 5 shows an exploded view of an exemplary embodiment of an improved reamer head 30 and split-bit reamer arm 34. The improved reamer head 30 has a frustoconical, truncated cone (via truncated end 33), or conical frustum shape or substantially frustoconical, truncated cone, conical frustum shape, or frustoconical body 32. The improved reamer head 30 has teeth 38. The improved reamer head 30 rotates about its center axis 36 and has center of rotation, located at its imaginary apex/geometrical 40, which can/will align with the center of rotation or centerline 56 of a split-bit reamer (not shown in FIG. 5, but represented in FIG. 6 or 7) for reducing friction/drag externally as the reamer 50 moves into/through the hole 52 and circumferentially reams surrounding walls 53 (causing friction/drag) to create a larger hole 54. The imaginary/geometrical apex 40 is the apex of imaginary/geometrical conical surfaces 39*a*, 39*b* of improved reamer head 30. The imaginary/geometrical conical surfaces 39*a*, 38*b* may be an imaginary/geometrical projection or extrapolation based upon the shape (e.g. frustoconical, truncated cone, or conical frustum shape or substantially frustoconical, truncated cone, or conical frustum shape) of improved reamer head 30 (or more specifically of frustoconical body 32) and defines an imaginary/geometrical conical shape 41. As the radius of the frustoconical or truncated conical body 32 varies along its height, the imaginary/geometrical apex 40 (omitted from the frustoconical body 32) can be matched to or mounted to be coincidental with (or superimposed upon) the center of rotation at 40 (along centerline 56) of the fully assembled reaming apparatus. Each reamer head 30 defines a center cavity or bore 35 (generally shown in FIG. 5 and FIG. 9) for mounting on arm 34 that may accommodate bearings 92, 94, 96 (see FIG. 9) or have a bearing surface (not shown) for mounting on and rotation about the arm 34.

In FIG. 5, in one embodiment, the frustoconical body 32 may be about sixty-five to seventy-five percent relative to the size or volume of a full cone (i.e. as defined by the imaginary/geometrical conical shape 41).

Figure 6:
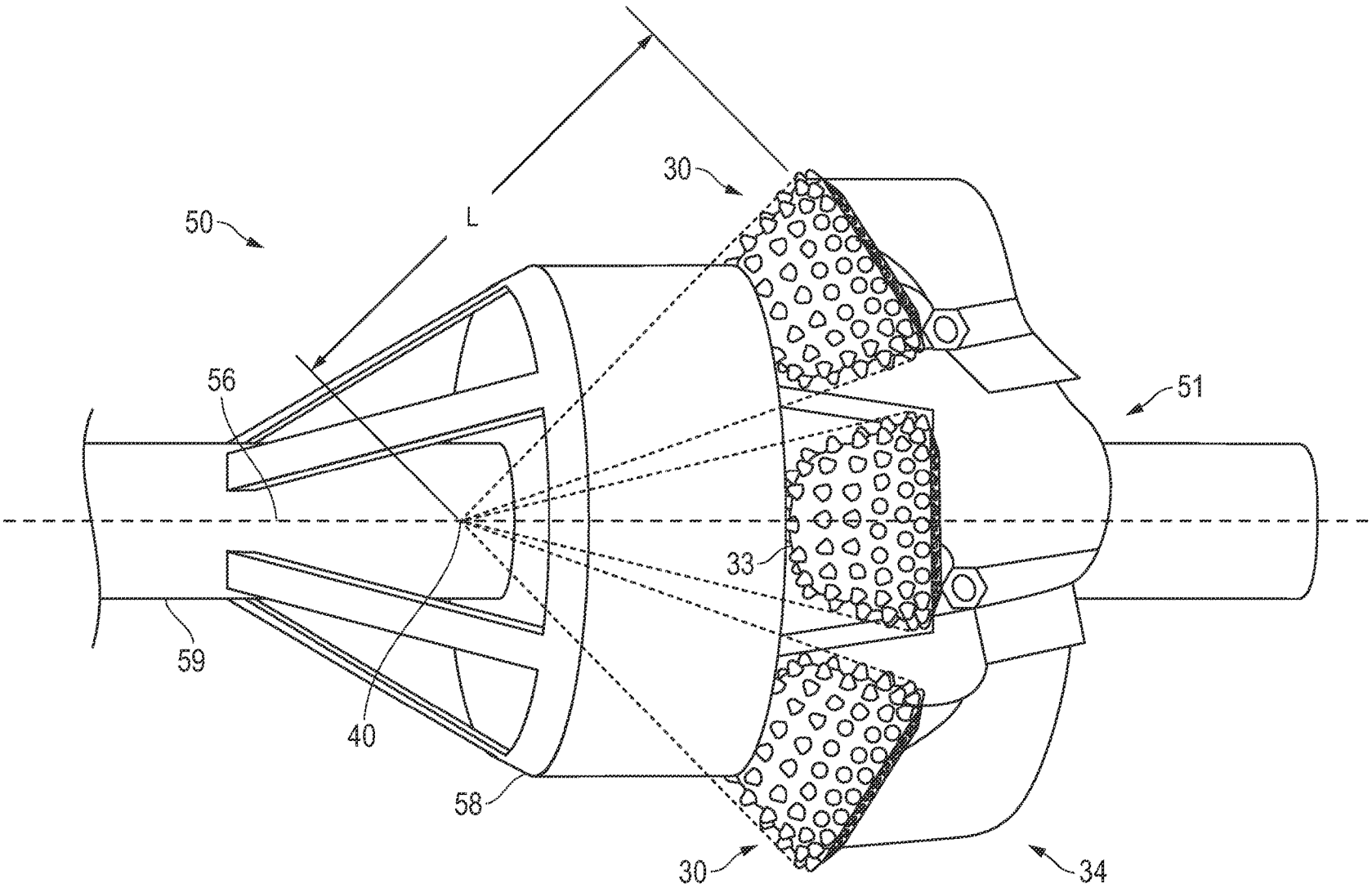
FIG. 6 shows a perspective view of an exemplary embodiment of a split-bit reamer or reaming apparatus featuring mounted improved reaming heads.

FIG. 6 shows a perspective view of an exemplary embodiment of a split-bit reamer or reaming apparatus 50 featuring mounted improved reaming heads 30. The split-bit reamer 50 may be attached to a reamer line 59 through which muds or drilling fluids (not shown) travel. The exemplary embodiment of the split bit reamer 50 shown usually has a centralizing ring or shroud 58 connected to the body 51 of the split-bit reamer 50, with a plurality of arms 34 extending from the body 51, wherein an improved reaming head 30 is mounted to each of the plurality of arms 34. The split-bit reamer 50 rotates about its centerline or central axis 56 (defined by the split-bit reamer 50 and/or the reamer line 59).

Figure 7:
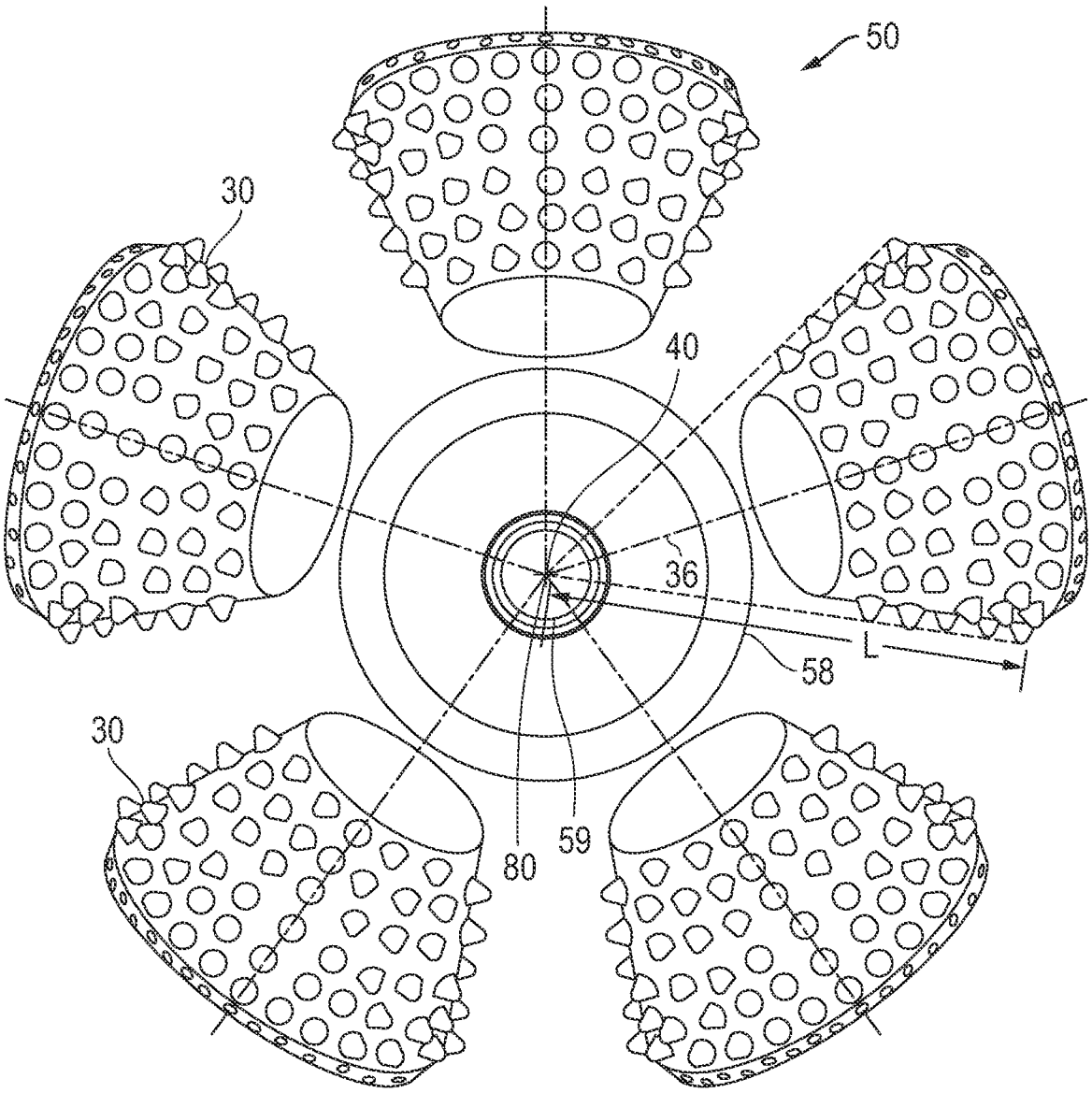
FIG. 7 shows a schematic view along the axis of rotation of an exemplary embodiment of a split-bit reamer featuring mounted improved reaming heads.

FIG. 7 shows a schematic view along the axis of rotation of an exemplary embodiment of a split-bit reamer 50 featuring mounted and symmetrically arranged improved reaming heads 30 and centralizing ring 58. The center of rotation at imaginary/geometrical apex 40 (along center axis 36) for each of the improved reaming heads 30 aligns or coincides (i.e. at a distance L represented in FIG. 5) with the center of rotation of the reamer 80 along the reamer centerline axis 56 (shown in FIG. 6). In other words, the center axis 36 of each respective reaming head 30 intersects the reamer centerline axis 56 coinciding with the imaginary/geometrical apex 40 at center of rotation of the reamer 80.

Figure 1:
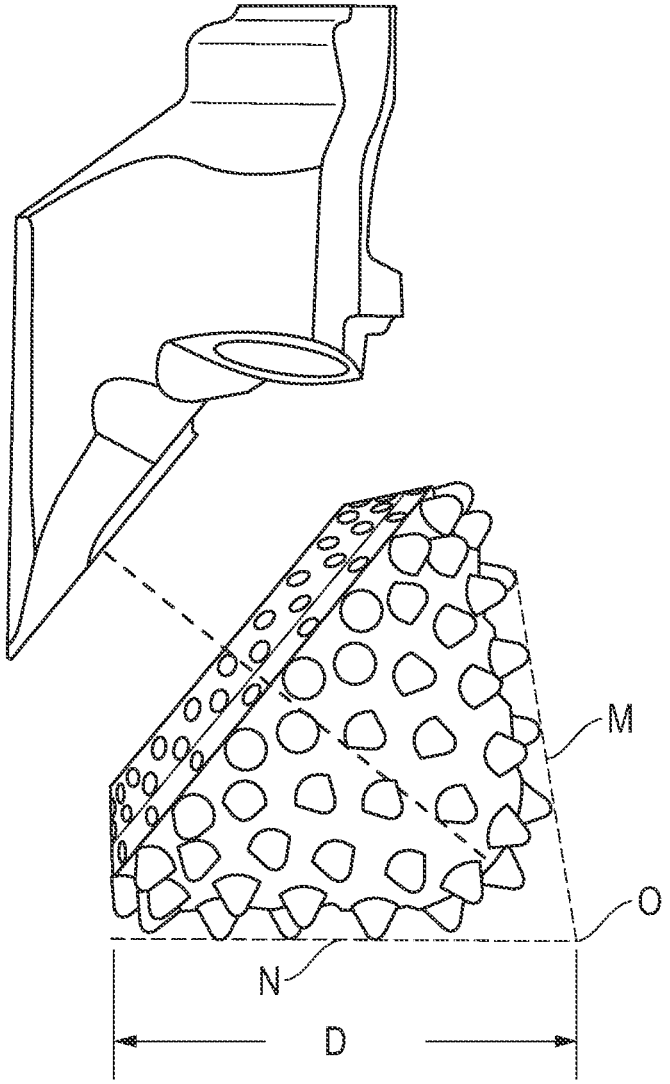
FIG. 1 (Prior Art)
FIG. 1 shows an exploded view of a 'Prior Art' drill bit and arm.
Figure 2:
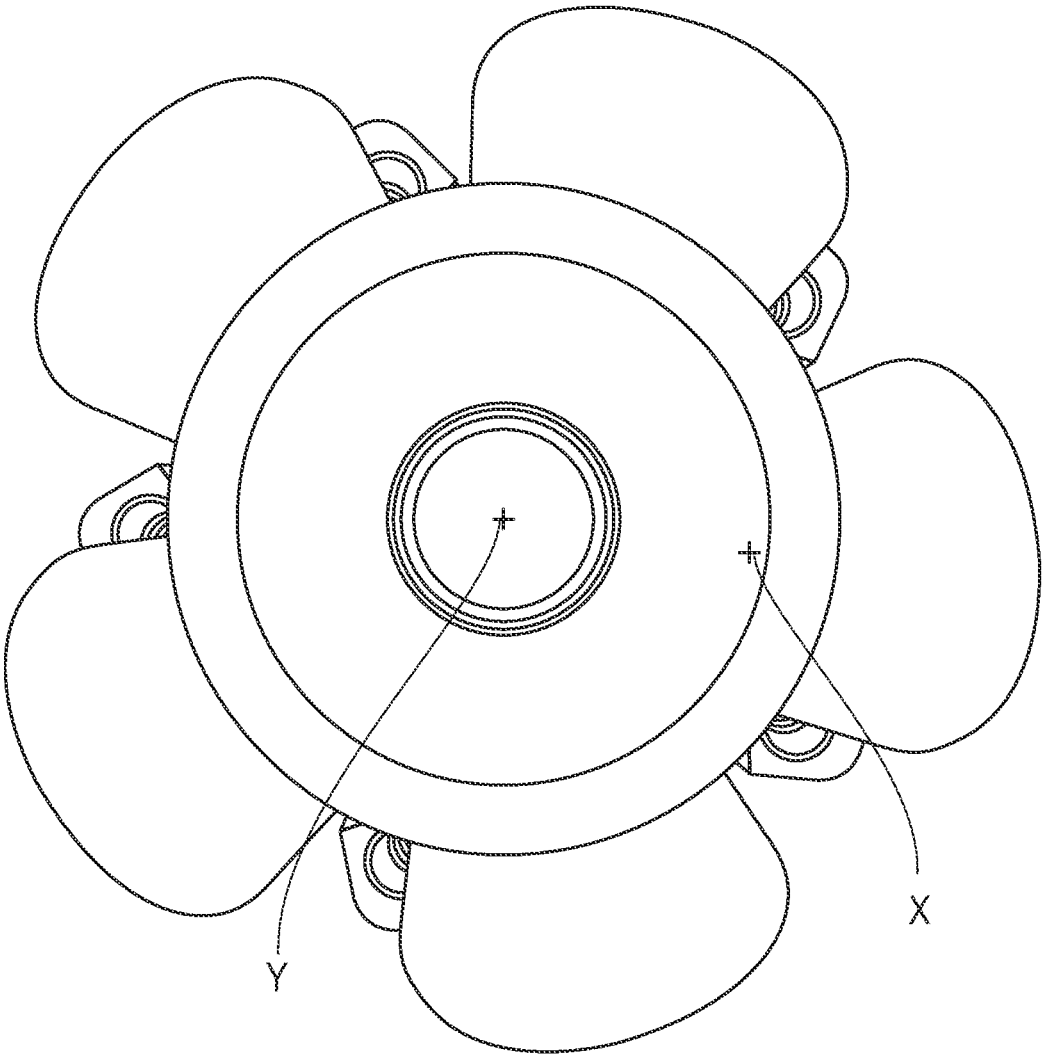
FIG. 2 (Prior Art)
FIG. 2 shows a schematic view along the axis of rotation of a 'Prior Art' reaming apparatus or reamer having drill bit cones as reaming heads.
Figure 8:
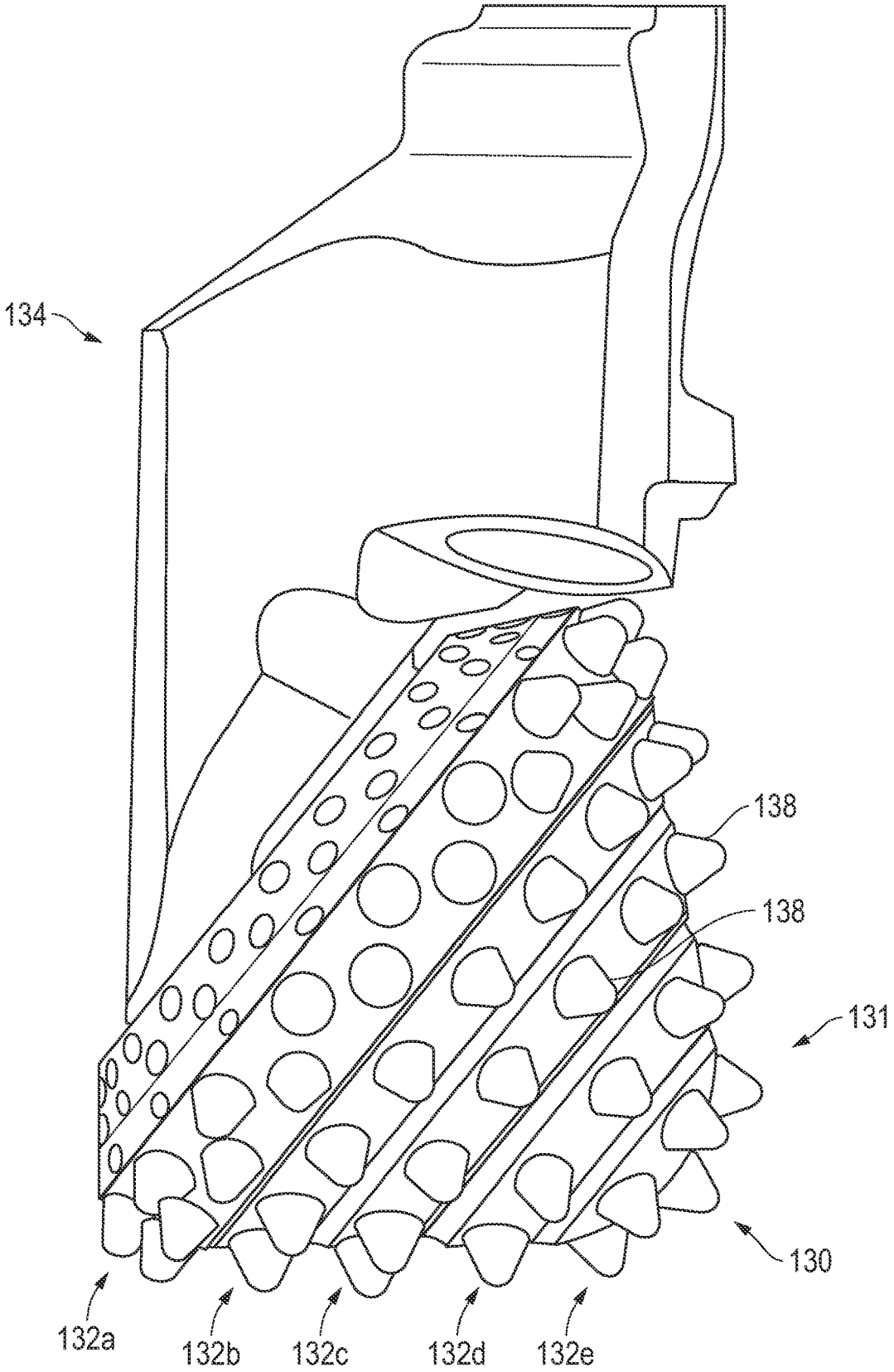
FIG. 8 shows a side view of an exemplary embodiment of a progressive independently segmented reaming head mounted to an arm of a split-bit reamer.

FIG. 8 shows a side view of an exemplary embodiment of a progressive independently segmented reamer head 130 mounted to an arm 134 of a split-bit reamer (not shown but mounted similar as represented in FIG. 2). This exemplary embodiment of a progressive independently segmented reaming head 130 comprises stacked, annular segments or pieces 132 which are collectively mounted to form a cone or conical shape or substantially cone shape 131. Each of the respective stacked, annular segments or pieces 132*a-e* may each be truncated cones or frusto-conical shaped or conical frustums all varying sequentially in radius along the height of the progressive independently segmented reamer head 130. The segment 132*e* at the apex of the cone shape 131 or the tip of the reamer head may be conical or substantially conical (or may alternatively annular similar to other segments, yet having the smallest radius that varies along its height). The stacked pieces 132 have a consecutively larger diameter along the height or length of the reamer head 130 (starting from the apex) and independently rotate on a center shaft (not shown) in forming the cone-shaped 131 progressive independently segmented reaming head 130. Each of the independently rotational and stacked annular truncated conical segments 132*a-e* respectively has a plurality of teeth 138 mounted thereon. Each of the respective stacked, annular segments or pieces 132*a-e* has a center bore (not shown) for mounting on arm 134 that may accommodate bearings (not represented in FIG. 8) or have a bearing surface (not shown) for mounting on and rotation about the arm 134. It is to be appreciated that each of the respective stacked, annular segments or pieces 132*a-e* may independently rotate (subject to any frictional forces) for reducing friction/drag externally as the reamer 50 moves into/through the hole 52 and circumferentially reams walls 53 (causing friction/drag) to create a larger hole 54.

Figure 3:
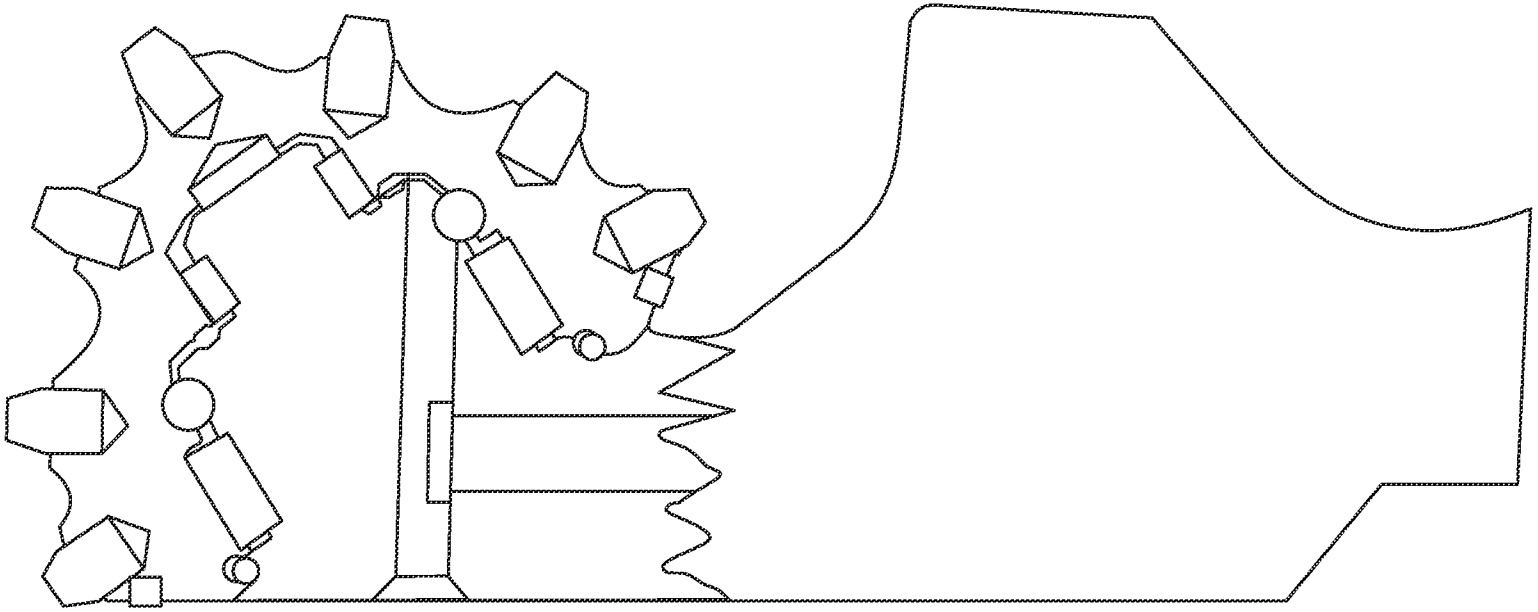
FIG. 3 (Prior Art)
FIG. 3 shows a partial sectional view of a 'Prior Art' bearing mechanism in combination with a drill bit cone as a reaming head.
Figure 9:
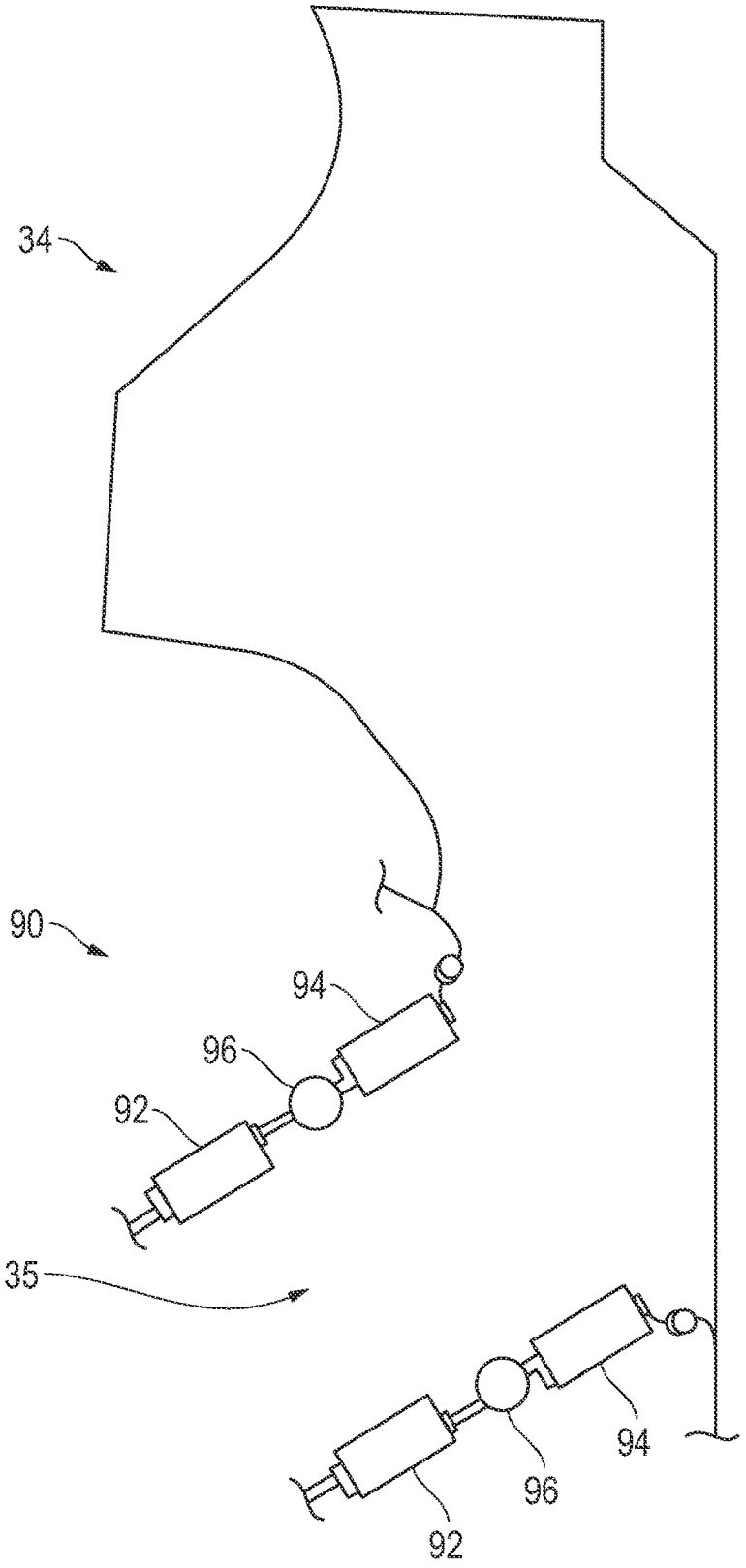
FIG. 9 shows a partial sectional view of an exemplary embodiment of an improved bearing mechanism 90 between an arm 34 of a split-bit reamer (not shown) and an improved reaming head (not shown).

FIG. 9 shows a partial sectional view of an exemplary embodiment of an improved bearing mechanism 90 between an arm 34 of a split-bit reamer 50 (shown in FIGS. 6-7) for mounting of an improved reaming head 30 (shown in FIGS. 5-7). The improved bearing mechanism 90 in this sectional view includes an upper cylindrical bearing 94 and a lower cylindrical bearing 92, and in one embodiment, each of the cylindrical bearings 92, 94 being the same size or substantially the same size (this is to be contrasted with FIG. 3 and its related discussion above; note in FIG. 9 bearing 92 is relatively longer as compared/contrasted to FIG. 3 bearings proximate the apex due to the reduction of angularity in the embodiments of FIGS. 5, 6, 7 & 9, e.g. by way of example only, 5°-25° reduction of angularity). The angularity and design of the bearings is matched to fit the embodiments represented in FIGS. 5-7. The length of the upper cylindrical bearing 94 relative to the lower cylindrical bearing 92 is not necessarily drawn to scale in FIG. 9 but shown schematically and it is to be appreciated they may be of substantially the same length and/or width.

Related to the bearing mechanism 90, horizontal directional drilling has many unique challenges specific to the industry. Because it is very often large diameter and mainly works horizontal or near horizontal, a horizontal directional drilling reaming assembly/split-bit reamer 50 has a significant amount of weight and thus is subject to considerable lateral forces (forces that are not exerted on the cutting face 62 [shown schematically in FIG. 4] of the split-bit reamer tool 50, but on the lower lateral side 64 of its body 51). The most important unique challenge is the lateral forces which significantly affect how a horizontal directional drilling split-bit reaming tool 50 works and how a horizontal directional drilling reaming tool 50 wears over time. Additionally, other unique challenges are the stresses on a horizontal drill pipe and the relatively large diameter of a horizontal reamed bore 54. In essence the geometry of the reamer heads 30 in relation to the centerline axis 56, as described above with respect to FIG. 7, allows a uniform workload on the different rows of teeth 38 (every tooth, independently in what row is located, will be crushing the same amount of rock than any other tooth in the reamer head 30) resulting in the advantage of generating an increment in the rate of penetration of the horizontal directional drilling reaming apparatus 50 as well as extending its lifetime. This geometry of the reamer heads 30 in relation to the centerline axis 56, as described above with respect to FIG. 7, also allows the incremental thickness T of the bottom flange 198 of the reaming head journals 190 (see FIG. 11, the reaming head journals 190 are the pieces that protrude from the arms 34 and that run through the internal cavity of the reamer head roller cones 30—along the axis 36 that holds the reamer head roller cones 30 in position and serve as an internal race for the bearing mechanism 90 allowing the reamer head cones 30 to rotate). This flange T is important because, as previously mentioned, in horizontal directional drilling the lateral forces exerted across lateral sides 64 on the reamer head's cones 30 are always high which can lead to catastrophic failure or breakage. These forces are mainly due to the overall weight of the HDD reaming tool/apparatus 50 (the reamer head cones 30 and bearing mechanism 90 components that at a given time are located under or falling on the lower side or region 64 of the assembled HDD reaming tool/apparatus 50 must support the full weight of the overall assembled reaming tool 50). In standard vertical oil drilling these lateral forces are relatively significantly smaller if compared with the lateral forces exerted in horizontal directional drilling, and the diameters at which the holes are drilled are relatively much smaller comparative to the diameter 54 of horizontal directional drilling reaming, therefore, the weight of the respective hole openers is completely different.

Figure 11:
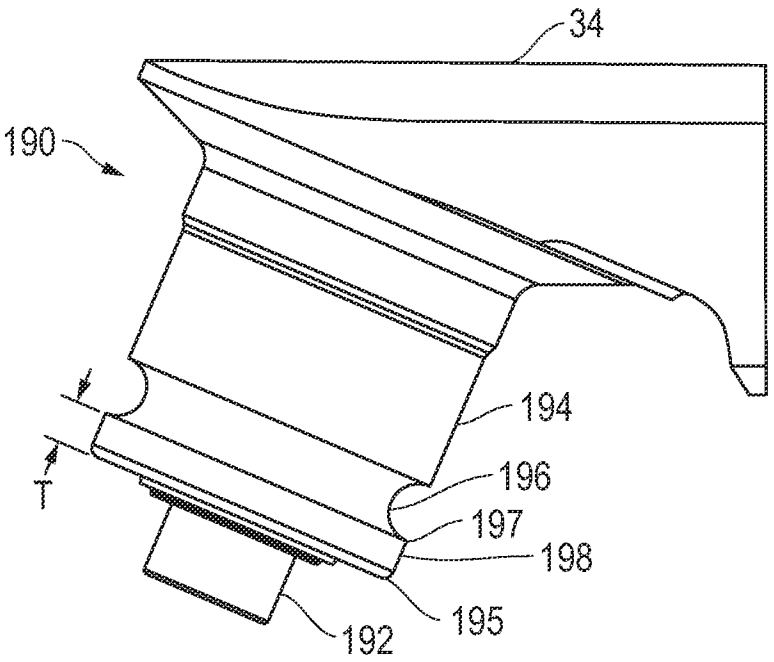
FIG. 11 shows a partial view of an exemplary embodiment of an improved reaming head journal having increased flange thickness.

FIG. 11 shows a partial view of an exemplary embodiment of an improved reaming head journal 190 for the bearing mechanism 90 (shown in FIG. 9) from the arm 34 of a split-bit reamer 50 (shown in FIGS. 6-7). The improved reaming head 30 (shown in FIGS. 5-7) is mounted over the reaming head journal 190 with the bearing mechanism 90 interposed or there-between the reaming head journal 190 and the reaming head 30. The reaming head journal 190 has a lower journal bearing seat 192 for abutting or contiguous with the lower cylindrical bearings 92, an upper journal bearing seat 194 for abutting or contiguous with the upper cylindrical bearing 94, and an intermediate journal bearing/retaining seat 196 for abutting or contiguous with the retaining spheres/ball bearings 96. The reaming head journal 190 includes a flange 198 defined between one end 197 of the intermediate journal bearing/retaining seat 196 and another end 195 of the lower journal bearing seat 192 (the flange 198 supports and is contiguous with retaining spheres/balls bearings 96 and lower cylindrical bearings 92 when the reaming head 30 is mounted on the reaming head journal 190). The distance T between one end 197 of the intermediate journal bearing/retaining seat 196 and another end 195 of the lower journal bearing seat 192 defines the thickness T of the flange 198. The thickness T of the flange 198 must support the lateral forces applied to the reamer 50, and support thrust on the reaming head 30, all as translated through the retaining spheres/ball bearings 96.

Various example diameters for the horizontal directional drilling ("HDD") reaming operations are 91.44 cm (36 inches) diameter, 106.68 cm (42 inches), 121.92 cm (48 inches), 137.16 cm (54 inches), and a 152.4 cm (60 inches) diameter. These examples may cover about eighty percent of the Applicant's reaming operations, and the larger or widened diameter HDD reamed hole 54 may be dependent upon the standard pipeline size to be finally installed in the widened HDD reamed hole 54.

Figure 10:
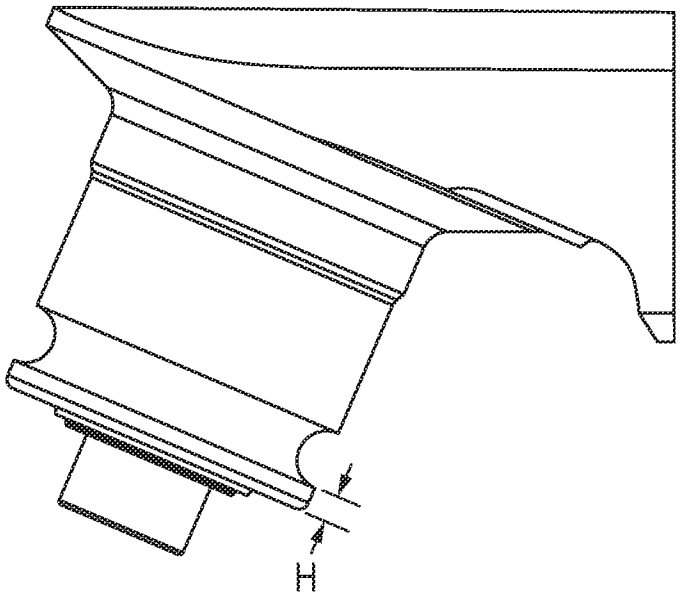
FIG. 10 shows a partial view of a typical largest size bearing assembly journal used for the mount of a drill bit cone.

In one working example in which the HDD reamer operation is designed to ream at least a 121.92 cm (48 inches) path or widened reamed hole 54, the full weight of the overall assembled reaming tool 50 may be approximately 5443 kilograms (12,000 lbs.), the flange thickness T may be about 2.286 centimeters (0.9 inches). This flange thickness T of 2.286 cm (0.9 inches) represented generally in FIG. 11 is to be compared and contrasted to the standard thickness H of about 1.38938 cm (0.547 inches) represented in FIG. 10 (FIG. 10 shows a partial view of a typical 'largest size' bearing assembly journal used for the mount of a drill bit cone). Therefore, the flange thickness T is at least fifty percent (50%) thicker than the standard thickness H, and in the case of the 121.92 cm (48 inch) diameter reaming apparatus 50 the flange thickness T is sixty-four percent (64%) thicker than the standard thickness H (i.e. compare and contrast FIG. 10 to FIG. 11). As previously mentioned, in horizontal directional drilling the lateral forces exerted across lateral sides 64 on the reamer head's cones 30 are always high which can lead to catastrophic failure or breakage; and in the exemplary embodiment discussed the retaining spheres/balls bearings 96 will exert force on the flange 198 due to the lateral forces (including the weight of the overall assembled reaming tool 50 being approximately 5443 kilograms (12,000 lbs.) in the specific example discussed). Hence, the flange thickness T may be critical to the durability and efficiency of the assembled HDD reaming tool apparatus 50.

In a second representative working example in which the HDD reamer operation is designed to ream at least a 91.44 cm (36 inches) path/widened reamed hole/underground arcuate path 54 the overall assembled reaming tool 50 mass may be approximately 1723.65 kilograms (3,800 lbs.) which correlates to the flange thickness T as described above which is at least fifty percent (50%) thicker than the standard thickness H.

In a third representative working example in which the HDD reamer operation is designed to ream at least a 106.68 cm (42 inches) path/widened reamed hole/underground arcuate path 54 the overall assembled reaming tool 50 mass may be approximately 3583.38 kilograms (7,900 lbs.) which correlates to the flange thickness T as described above which is at least fifty percent (50%) thicker than the standard thickness H.

In a fourth representative working example in which the HDD reamer operation is designed to ream at least a 137.16 cm (54 inches) path/widened reamed hole/underground arcuate path 54 the overall assembled reaming tool 50 mass may be approximately 6032.78 kilograms (13,300 lbs.) which correlates to the flange thickness T as described above which is at least fifty percent (50%) thicker than the standard thickness H.

In a fifth representative working example in which the HDD reamer operation is designed to ream at least a 152.4 cm (60 inches) path/widened reamed hole/underground arcuate path 54 the overall assembled reaming tool 50 mass may be approximately 6713.17 kilograms (14,800 lbs.) which correlates to the flange thickness T as described above which is at least fifty percent (50%) thicker than the standard thickness H.

The foregoing addresses that problems due to the teeth 38 relatively closer to the tip/apex 40 proximate truncated end 33 of the reamer heads 30 do not have enough tangential speed around the cone's axle 36 to match the tangential (circumferential) speed established by the rotation of the HDD split-bit reaming tool apparatus 50. As a consequence of this significant mechanical inefficiency, the teeth 38 successively and relatively closer to the apex 40 proximate truncated end 33 of the reamer heads 30 have imperfect contact with the earth, ground, or rock which causes teeth 38 to slide or drag over the rock, inefficiently scratching or scrapping its surface and often ineffectively drilling or crushing the earth, ground, or rock. This produces an effect of skidding over the rock face instead having a perfect contact and causes teeth 38*a* successively and relatively closer to the apex 40 proximate truncated end 33 of the reamer heads 30 to become flat (worn) sooner than the gauge teeth 37. Hence, the problem lies in that [t]he mechanical inefficiency is due to the fact that the tangential (circumferential) speed of the teeth 38 closer to the apex 40 proximate truncated end 33 of the reamer head 30 is lower than the required speed relative to their position on the HDD split-bit reaming tool apparatus 50. Since the tangential speed of the teeth 38 depends on the angular speed of the reamer head 30 and the radius from the cone axle 36 at what the respective teeth 38 are located, due to the triangular cross-sectional shape 39*a*, 39*b* of the cone (imaginary/geometrical conical shape 41), the teeth that are farther away or mounted at a greater radial distance from the axle 36 of the cone will have a higher tangential speed than the teeth close to the "tip/apex" 40 proximate truncated end 33 of the reamer heads 30. The teeth 37 located at a farther distance from the axle, i.e. the ones close to the "base" of the cone and referred to as gauge teeth 37, will create a higher momentum than the teeth 38 located closer to the axle 36 of the reamer head 30, i.e. the teeth relatively closer to the "tip/apex" 40 of the cone, once a friction force is created in between each respective tooth 38 and the earth, ground or rock that is being drilled (reamed). Due to this relative difference in momentum, the gauge teeth 37 will predominantly establish the rotational speed of the reamer head 30, which is the reason for the gauge row being named "driver row" by those skilled in the art (usually, the "perfect" rotation speed is located in an area in between the gauge row and the near gauge row, which are, the first and second rows starting from the "base" of the cone).

Additionally, the skidding explains why larger hole reaming operations require more torque to rotate the HDD reaming apparatus 50. This skidding creates frictional forces at a certain distance from the axis 56 of the hole opener, creating torque, which further compounds problems contributing to a decrease in the rate of penetration into the hole/underground arcuate path 54 to be reamed. In essence skidding results in a need for greater torque to rotate the HDD reaming apparatus 50; results in premature wear of the teeth 38 by the friction against the rock; increases the torsional forces exerted on the arms 34 that hold the reamer heads 30; and reduces the rate of penetration of the HDD reaming apparatus 50, plus increases the likelihood of catastrophic failures.

It is understood that the present disclosure is not limited to the particular applications and embodiments described and illustrated herein, but covers all such variations thereof as come within the scope of the claims. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The reference numbers in the claims are not intended to be limiting in any way nor to any specific embodiment represented in the drawings, but are included to assist the reader in reviewing the disclosure for purposes of a provisional filing.

The invention claimed is:

1. An apparatus for horizontal directional drilling reaming an underground arcuate path after a pilot hole has been drilled, comprising:

a reamer line defining a centerline axis;

a body comprising a centralizing ring, a plurality of arms connected to the centralizing ring, and a plurality of reamer heads, one each of the reamer heads respectively mounted and corresponding to one each of the plurality of arms;

wherein the body is connected to the reamer line for centering the horizontal directional drilling reaming apparatus in the underground arcuate path;

wherein the plurality of reamer heads are symmetrically arranged around the centralizing ring;

a plurality of teeth mounted to each reamer head, wherein each of the plurality of teeth is configured to rotate and ream the underground arcuate path;

wherein each of the reamer heads comprises a frustoconical body;

wherein the frustoconical body defines a cavity configured to receive at least one bearing;

wherein the plurality of teeth are mounted to the frustoconical body;

wherein the frustoconical body is truncated across one end;

wherein the frustoconical body defines a geometrical apex projecting beyond the truncated end that coincides with the centerline axis of the horizontal directional drilling reaming apparatus for reaming a relatively larger diameter hole of at least 91.44 cm, wherein the frustoconical body has an increased rate-of-penetration, and wherein the plurality of teeth mounted on the frustoconical body have an increased mechanical efficiency including any teeth relatively and successively closer to a tip of each reamer head, for the horizontal directional drilling reaming of the underground arcuate path;

wherein the body has a quantity of weight determined by a size of the horizontal directional drilling reaming apparatus;

wherein the body has a lower lateral side;

wherein lateral forces are exerted across the lower later side according to the quantity of weight of the body against the relatively larger diameter hole during horizontal directional drilling reaming operations;

a plurality of reaming head journals, one each respectively connected to each of the plurality of arms in intermediate relationship with respect to each of the reamer heads;

wherein each of the reaming head journals defines a lower journal bearing seat, an upper journal bearing seat, and an intermediate journal retaining seat;

wherein each of the remaining head journals includes a flange defined between one end of the intermediate journal retaining seat and another end of the lower journal bearing seat; and wherein a thickness of the flange is variable according and relative to the quantity of weight of the body and the lateral forces exerted across the lower later side of the body against the relatively larger diameter hole during horizontal directional drilling reaming operations.

2. The apparatus for horizontal directional drilling reaming the underground arcuate path after a pilot hole has been drilled according to claim 1, wherein the frustoconical body of each of the reamer heads defines a geometrical conical surface having a distance L; wherein the geometrical apex is located at the distance L; wherein the centerline axis coincides with the distance L; and wherein the geometrical apex is superimposed upon the centerline axis at the distance L.

3. The apparatus for horizontal directional drilling reaming the underground arcuate path after a pilot hole has been drilled according to claim 1, wherein the thickness of the flange is at least fifty percent greater than a standard thickness of typical bearing assembly journal for a drill bit cone.

4. The apparatus for horizontal directional drilling reaming the underground arcuate path after a pilot hole has been drilled according to claim 1, wherein the thickness of the flange is sixty-four percent greater a standard thickness of typical bearing assembly journal for a drill bit cone.

5. The apparatus for horizontal directional drilling reaming the underground arcuate path after a pilot hole has been drilled according to claim 1, wherein the thickness of the flange is at least 2 cm.

6. The reamer apparatus for horizontal directional drilling reaming an underground arcuate path after a pilot hole has been drilled of claim 1, further comprising:

a plurality of cylindrical bearings respectively mounted between each of the respective reaming head journals and each of the respective reamer heads within the lower journal bearing seat, and the upper journal bearing seat;

wherein the cavity in the frustoconical body has a truncated cone profile, wherein the truncated cone profile accepts at least two levels of the plurality of cylindrical bearings also accepted within the lower journal bearing seat, and the upper journal bearing seat, wherein the level of cylindrical bearings proximate a truncated end is substantially the same size as the other level due to a geometrical apex as determined by the truncated end.

7. A method for horizontal directional drilling reaming an underground arcuate path after a pilot hole has been drilled with a horizontal directional drilling reaming apparatus comprising the steps of:

providing said horizontal directional drilling reaming apparatus, wherein said horizontal directional drilling reaming apparatus comprises:

a reamer line defining a centerline axis;

a body comprising a centralizing ring, a plurality of arms connected to the centralizing ring, and a plurality of reamer heads, one each of the reamer heads respectively mounted and corresponding to one each of the plurality of arms;

wherein the body is connected to the reamer line for centering the horizontal directional drilling reaming apparatus in the underground arcuate path;

wherein the plurality of reamer heads are symmetrically arranged around the centralizing ring;

a plurality of teeth mounted to each reamer head, wherein each of the plurality of teeth is configured to rotate and ream the underground arcuate path;

wherein each of the reamer heads comprises a frustoconical body;

wherein the frustoconical body defines a cavity configured to receive at least one bearing;

wherein the plurality of teeth are mounted to the frustoconical body;

wherein the frustoconical body is truncated across one end;

wherein the frustoconical body defines a geometrical apex projecting beyond the truncated end that coincides with the centerline axis of the horizontal directional drilling reaming apparatus for reaming a relatively larger diameter hole of at least 91.44 cm, wherein the frustoconical body has an increased rate-of-penetration, and wherein the plurality of teeth mounted on the frustoconical body have an increased mechanical efficiency including any teeth relatively and successively closer to a tip of each reamer head, for the horizontal directional drilling reaming of the underground arcuate path;

wherein the body has a quantity of weight determined by a size of the horizontal directional drilling reaming apparatus;

wherein the body has a lower lateral side;

wherein lateral forces are exerted across the lower later side according to the quantity of weight of the body against the relatively larger diameter hole during horizontal directional drilling reaming operations;

a plurality of reaming head journals, one each respectively connected to each of the plurality of arms in intermediate relationship with respect to each of the reamer heads;

wherein each of the reaming head journals defines a lower journal bearing seat, an upper journal bearing seat, and an intermediate journal retaining seat;

wherein each of the reaming head journals includes a flange defined between one end of the intermediate journal retaining seat and another end of the lower journal bearing seat;

wherein a thickness of the flange is variable according and relative to the quantity of weight of the body and the lateral forces exerted across the lower later side of the body against the relatively larger diameter hole during horizontal directional drilling reaming operations; and horizontal directional drilling reaming through the pilot hole for reaming the underground arcuate path having a larger diameter hole using said horizontal directional drilling reaming apparatus.

* * * * *